United States Patent [19]

Lockhart

[11] Patent Number: 4,706,994

[45] **Date of Patent: * Nov. 17, 1987**

[54] REPORT COVER

[76] Inventor: William E. Lockhart, 7324 Campbell Rd., Dallas, Tex. 75248

[ * ] Notice: The portion of the term of this patent subsequent to Oct. 22, 2002 has been disclaimed.

[21] Appl. No.: 726,489

[22] Filed: Apr. 24, 1985

Related U.S. Application Data

[63] Continuation of Ser. No. 445,148, Nov. 29, 1982, Pat. No. 4,548,426.

[51] Int. Cl.[4] ..... B42D 3/00; B42D 15/00; B41L 3/00; B42C 11/00

[52] U.S. Cl. ..... 281/29; 282/29 R; 283/63 R; 412/4

[58] Field of Search ..... 281/1, 29, 33; 282/11.5 R, 29, 22 R; 283/63 A, 63 R; 412/1, 4, 6

[56] References Cited

U.S. PATENT DOCUMENTS

| | | | |
|---|---|---|---|
| 1,439,138 | 12/1922 | White | 281/1 |
| 1,614,977 | 1/1927 | Ausmus | 281/33 |
| 3,111,126 | 11/1963 | Brinkman to Broxten | 129/25 |
| 4,240,761 | 12/1980 | Jacobson | 137/557 |

FOREIGN PATENT DOCUMENTS

| | | | |
|---|---|---|---|
| 127964 | 12/1931 | Austria | 281/29 |
| 456901 | 4/1950 | Italy | 281/29 |
| 842594 | 7/1960 | United Kingdom | 282/22 R |

OTHER PUBLICATIONS

Brochure illustrating Quick Bind System Sold by Gestetner Corporation, Gestetner Park, Yonkers, N.Y. 10701

*Primary Examiner*—Frank T. Yost
*Assistant Examiner*—Paul M. Heyrana
*Attorney, Agent, or Firm*—Richards, Harris, Medlock & Andrews

[57] ABSTRACT

A report cover (10) is disclosed for securing and protecting a report (12). The report cover (10) includes a front panel (14) and a rear panel (16). Three parallel hinges (22,24,26) are formed in the front panel (14). A single hinge (36) is formed in the rear panel (16). The report is secured between the front and rear panels near the first edges (20,34) of the panels as by staples. The front panel (14) is then folded about the hinges to lie parallel to and adjacent the rear panel. The front and rear panels are secured along a line distant from the first hinge (36) by an adhesive strip (38). The first hinges (22,36) of each panel permits certain portions (58,60,62) of the panels and report to pivot about the hinges to eliminate any force tending to open or close the report. A cover (18) can be provided. In the alternative, a front cover (70) can be employed with the front panel (14) forming a rear cover.

14 Claims, 9 Drawing Figures

REPORT COVER

This is a continuation of application Ser. No. 445,148 filed Nov. 29, 1982 now U.S. Pat. No. 4,548,426.

TECHNICAL FIELD

This invention relates to apparatus for securely and conveniently holding documents, and in particular to a report cover for holding documents.

BACKGROUND ART

Documents, such as audit and business reports, tax returns and proposals, are often secured within a report cover. The cover can be used to protect the documents and reduce the likelihood of damage thereto. The cover is often employed to impress the recipient and to increase the perceived value of services rendered. Ideally, the report cover should secure the report therein yet permit ease of access to the report. In particular, if the report is opened to a certain page while lying on a desk, the report cover should not cause pages of the report to fly back or have a tendency to close the report. It is also desirable to cover any staples or other fastening members to provide a more pleasing and professional appearance to the report. Ideally, the report cover should be reusable indefinitely and should permit the rapid insertion or deletion of the document therein to update the document.

Several attempts have been made to construct report covers having the above-noted features. One example is the QUICK BIND system sold by Gestetner Corporation of Gestetner Park, Yonkers, New York 10703. This system requires the punching of numerous small holes along one edge of each page in the document to accommodate costly binding members. A bar, having thin rod-like members extending from one side of the bar, is positioned on one side of the document, with the rod-like pins extending through the holes formed in the document. A second bar, having apertures for receiving the ends of each pin, is positioned on the opposite side of the document. The pins pass through the apertures in the second bar and are thermally bound thereto to secure the document. This system has several drawbacks. It is virtually impossible to open a document bound by this system and place it on a table without flyback of pages of the report or the report closing. Severe bending of the pages of the report or a paperweight may be necessary to keep the report open to the page desired. This bending can accidently tear individual sheets from the report, because the binding holes are extremely close to the edge of the document sheet. Also, it requires a separate and costly device to punch the holes in the paper and to bind the pins to the second bar. Misalignment of the punching tool will ruin pages of the document. The bars prevent ready filing of the documents within conventional filing systems and do not have a pleasing appearance. Once bound within the system, the removal of the document would essentially require the destruction of the binding system.

A multiple ring cover is also commonly used. This requires the cutting of circular or elongate holes in the document along an edge thereof. A binding member is provided which extends along the length of the document to be bound and on which are mounted loops, each comprised of two overlapping semicircular flexible rings, which can be threaded through the holes put in the document to secure the document together. This system has many drawbacks. Every document page and both covers must be carefully jogged and inserted into a special machine that punches holes in only a few sheets of paper at a time. Pages not properly jogged or inserted into the machine will be punched too close to the edge—and ruined. After punching, every hole in every sheet must be threaded over the member's circular rings which have been spread open by a special machine. The large, protruding binding member detracts from the professional appearance of the report and causes major problems in report handling, filing and mailing. Since all document pages are loosely bound and may be easily removed—either accidentally or intentionally—this system provides virtually no security for permanent reference to valuable documents.

The above binding techniques, and other techniques, have not been totally satisfactory. Each of these techniques has had one or more disadvantages such as mentioned previously. A need therefore exists for a report cover which satisfies most or all of the advantages noted above for a low manufacturing price.

SUMMARY OF THE INVENTION

In accordance with one aspect of the present invention, a report cover is provided for binding a report. The binder includes a front panel having a first edge and at least three parallel hinges approximate the first edge. A back panel is also provided. Fastening structure is provided for fastening the report between the front and back panels along one edge of the report. The fastening is made between the first edge of the front panel and the closest of said parallel hinges. The front panel is folded about the parallel hinges to cover the edge of the report and bind the report.

In accordance with another aspect of the present invention, a report cover is provided for a report which includes a front panel having a first edge and at least three parallel hinges proximate and extending parallel to the first edge. A back panel is provided having a first edge and at least one hinge proximate the first edge of the back panel and extending parallel thereto. Fastening structure is provided for fastening the report between the front and back panels along one edge of the report proximate the first edges of the front and back panels between the first edge and closest hinge of each panel. The front panel is folded at the hinges to cover the edge of the report and to extend along the back panel on the side opposite the report. Second fastening structure is provided for securing the back and front panels, the hinges proximate the first edge on each panel cooperating to permit the report to be opened to selected pages and remain open in the absence of an external force.

In accordance with yet another aspect of the present invention, a method is provided for forming a report cover. The method includes the steps of securing the report between front and back panels forming at least three parallel hinges proximate a first edge of a front panel and along one edge of the report. The method further includes the step of folding the front panel along the three parallel hinges to cover the edge of the report and securing the front and back covers together to bind the report. In addition, the product resulting from this method is also provided.

BRIEF DESCRIPTION OF THE DRAWINGS

A more complete understanding of the invention and its advantages will be apparent from the following Detailed Description when taken in conjunction with the accompanying Drawings, in which.

DETAILED DESCRIPTION

Figure 1:
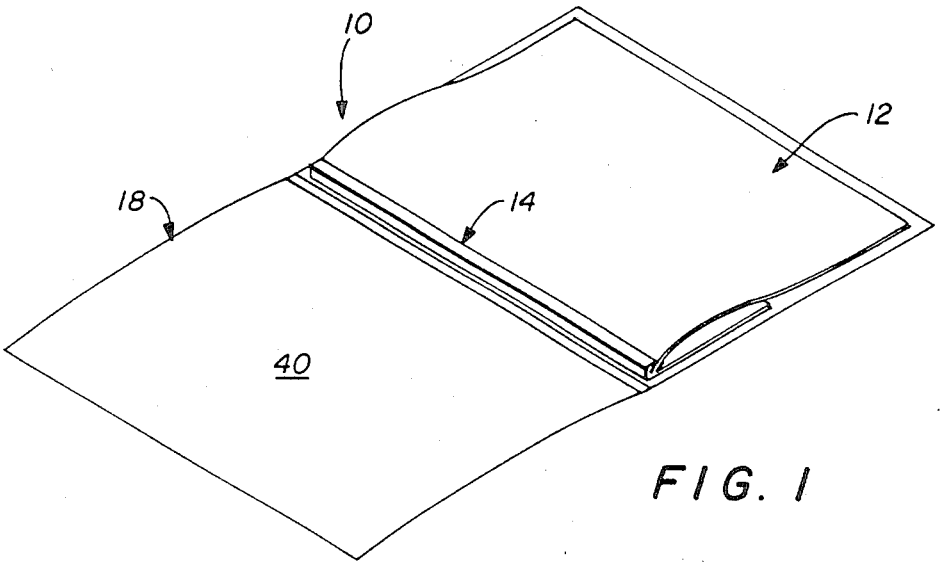
FIG. 1 is a perspective view of a report cover forming a first embodiment of the present invention.

Referring now to the Drawings, wherein like reference characters designate like or corresponding parts throughout several views, a report cover 10 is illustrated in FIGS. 1–4. The report cover 10 is intended to secure a report 12 therein. The report cover 10 acts to bind the report 12 and also provides protection to resist damage to the pages of the report 12. It will be understood that the report 12 can include paper documents as, for example, audit reports and tax returns, and any other materials with which the report cover 10 could be employed.

The report cover 10 includes a front panel 14, a rear panel 16 and a cover 18. The report cover 10 is designed for purchase by the final user with the panels 14 and 16 and cover 18 separate so that the user can assemble the report cover and report in a manner described hereinafter.

The front panel 14 is a generally rectangular piece of material, such as paper, with a length corresponding to the length of the report. A first edge 20 forms one edge of the front panel 14. A series of parallel hinges are formed proximate the first edge, including a first hinge 22, a second hinge 24, and a third hinge 26.

Each of the hinges 22, 24, and 26 extend parallel the first edge 20. The first hinge 22 is spaced a distance a from the edge 20. The second hinge 24 is spaced a distance b from the first hinge 22. The third hinge 26 is spaced a distance c from the second hinge 24. In the preferred construction, the distance b is larger than the distances a and c. The hinges 22, 24 and 26 can be formed by various techniques. For example, if the front panel 14 is formed of a relatively heavy weight paper, the paper can be scored along the position of the hinges to form the hinges.

Adhesive strips 28 and 30 are positioned on side 32 of the front panel 14. These adhesive strips 28 and 30 also extend generally parallel to the first edge 20. Each of the adhesive strips is positioned on the side of the hinges 22, 24 and 26 opposite the first edge 20 as seen in FIG. 2.

The rear panel 16 also has a first edge 34 forming one of the edges of the panel. A first hinge 36 is provided on the rear panel 16 parallel to and spaced distance d from the first edge 34. Again, the hinge can be formed by several methods, including the scoring of the hinge if the rear panel 16 is formed of a relatively heavy weight paper. An adhesive strip 38 is provided on the rear panel 16 and extends proximate the edge of the rear panel opposite the first edge 34.

The cover 18 generally includes a front cover portion 40, an end portion 42 and a rear cover portion 44. The cover 18 can be formed with portions 40, 42 and 44 by forming parallel hinges 46 and 48 separated by a distance e. If the cover 18 is formed of paper, the hinges 46 and 48 can be formed by scoring a line in the paper to form the hinges.

Figure 2:
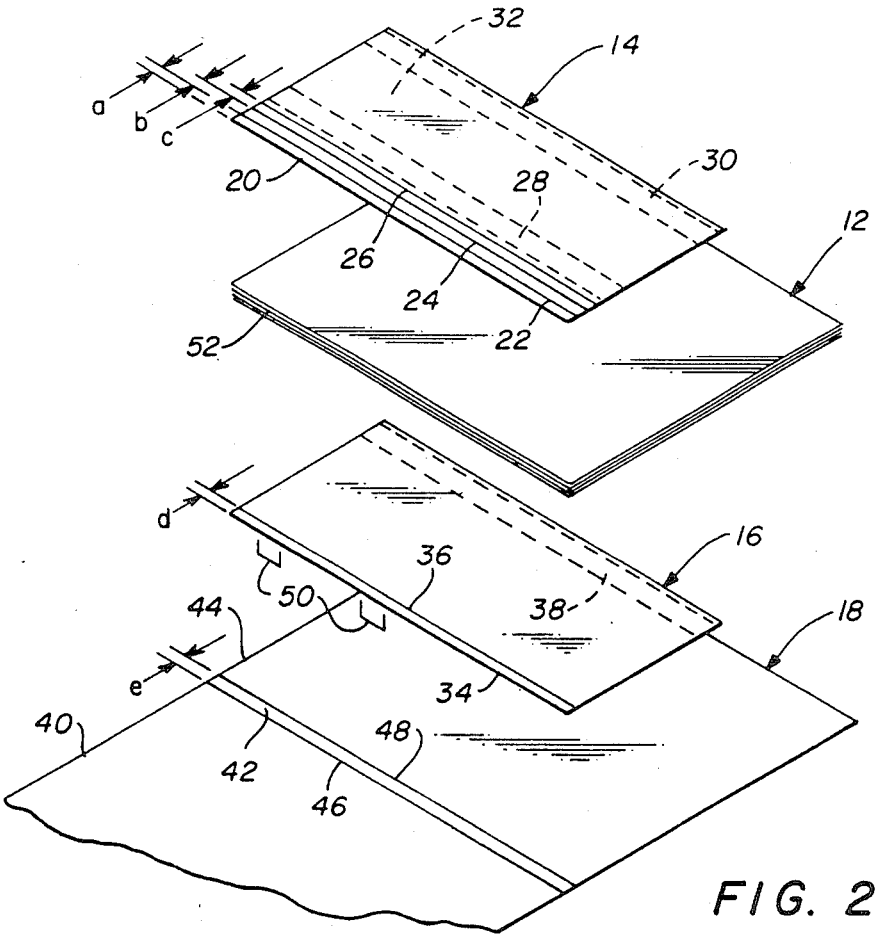
FIG. 2 is an exploded perspective view of the report cover shown in FIG. 1.
Figure 3A:
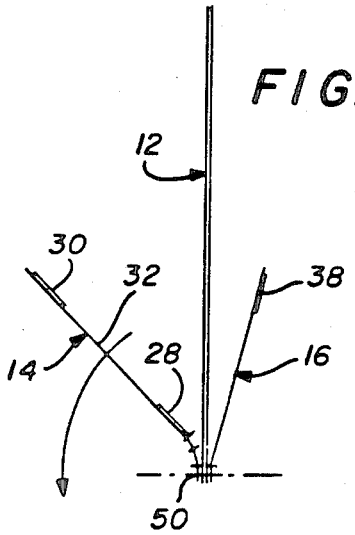
FIGS. 3*a–c* illustrate the folding of the front panel to bind the report between the front and back panels.

To bind the report 12 within the report cover 10, the front panel 14, rear panel 16, cover 18 and report 12 are positioned as shown in FIG. 2. The report 12 is then fastened between the front panel 14 and rear panel 16 along edge 52 as shown in FIG. 3*a*. The report can be fastened by staples 50 or any other suitable fastening structure. The report 12 is fastened to the front panel and rear panel within portions 60 and 62 of the panels, formed between the first edge and first hinge of each of the panels.

Figure 3B:
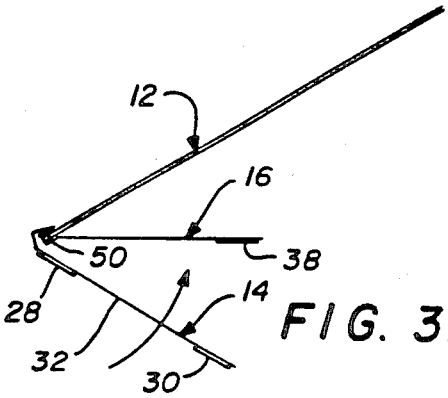
Figure 3C:
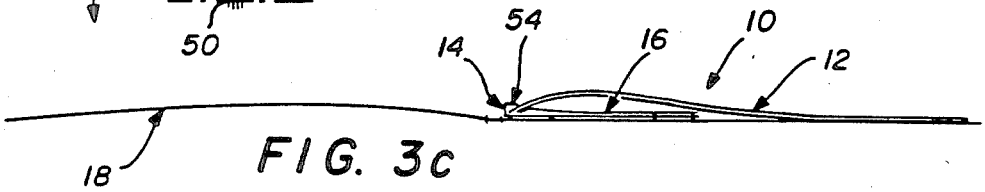

The front panel 14 is then folded about hinges 22, 24 and 26 as illustrated in FIGS. 3*a–c*. As the front panel 14 is folded, the front panel covers the edge 52 of the report 12 fastened between the front and rear panels. As can be seen in FIG. 3*c*, the front panel 14 is folded about the hinges until the portion of the front panel 14 extending from the third hinge 26 and having the adhesive strips 28 and 30 lies parallel and abutts the rear panel 16 on the side opposite the report 12. The adhesive strip 38 is then activated to secure the front and rear panels 14 and 16 in the position illustrated in FIG. 3*c*. The strip 38 can be activated by removing a nonstick protective layer from the strip or by activation through heating, moisturizing or other methods.

The front panel 14 and rear panel 16 combine to form a panel module 54. This module 54 is then secured to the cover 18 by activating the adhesive strips 28 and 30 to fasten the front panel 14 to the inside of the rear cover portion 44 near the end portion 42 as shown in FIG. 3*c*. Again, the adhesive strips 28 and 30 can be activated in a manner similar to adhesive strip 38.

Upon completion of the above recorded steps, the assembly of the report cover 10 has been completed with the report 12 fastened therein. The report cover 10 will permit the report 12 to be opened, as on a desk top, to a certain page in the report and will not cause flyback of pages or force the report to close. No external force or severe bending of the pages of the report are needed to keep the report open to the desired page as is commonly needed in the prior art.

Figure 4A:
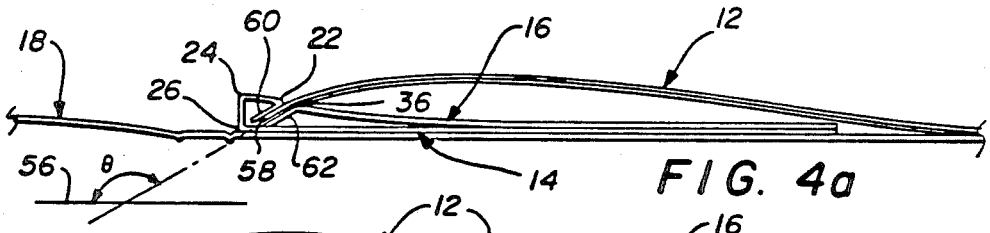
FIGS. 4*a–c* illustrate the pivoting action of the hinges in the front and back panels which permits the report to be opened to any page without the cover exerting a force to cause flyback of pages or close the report.
Figure 4B:
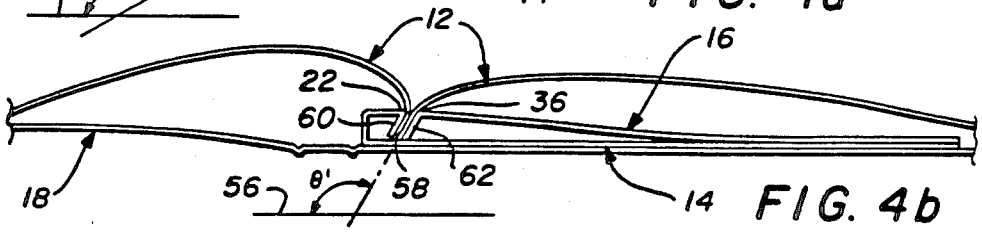

As can be seen in FIG. 4*a*, when the report cover 10 is initially placed on a desk top and the cover opened, the portion 58 of the report 12 secured between the front panel 14 and rear panel 16 lies along an angle $\theta$ relative to the desk top, represented by line 56. Portion 60 of the front panel 14 between the first edge 20 and first hinge 22 and the portion 62 of the rear panel 16 between the first edge 34 and first hinge 36 also lie in parallel planes to the portion 58 of the report 12 because of the staples 50. As one or more pages of the report 12 are opened, as shown in FIG. 4*b*, the portions 58, 60 and 62 each pivot about the first hinges 22 and 36 to angle $\theta'$ relative to the remainder of the report cover and desk. The angle $\theta'$ is determined in part by the number of pages of the report 12 on either side of the portion 58. As the user opens the report 12 to the back page of the report, as seen in FIG. 4*c*, the portions 58, 60 and 62 pivot further about the first hinges 22 and 36 to an angle $\theta''$.

Figure 4C:
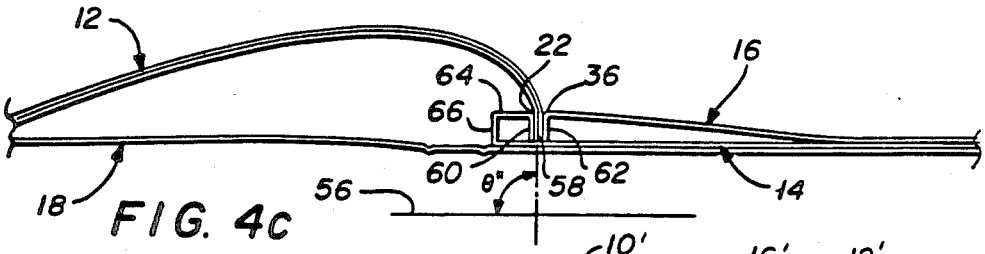

The adhesive strip 38, securing front panel 14 to back panel 16, is spaced a sufficient distance from hinge 36 to permit the portion of back panel 16 between hinge 36 and adhesive strip 38 to separate from front panel 14 as seen in FIGS. 4*a–c* to permit the hinging action about hinges 22 and 36. Generally, the panel module 54 defines a right triangle when viewed from the end, as in FIGS. 4*a–c*. The hypotenuse is formed by portion 64 of front panel 14 between hinges 22 and 24, and the portion of rear panel 16 between hinge 36 and adhesive strip 38. Portion 66 of front panel 24 between hinges 24 and 26 forms one side. The portion of front panel 24 between hinge 26 and adhesive strip 38 forms the final side of the triangle. The portions 58, 60 and 62 are pivoted at hinges 22 and 36 lying generally along the hypotenuse.

As each page of the report is opened, the pivoting action about the first hinges 22 and 36 prevents any force from developing which would cause the report 12 to close in part or in whole from the page selected by the user. This provides a great advantage in eliminating any need for an external force, such as a paperweight, to hold the pages open and eliminates the need for creasing the pages, a technique frequently employed in prior art covers to resist the closing of the report because of the particular design of the report cover.

In the preferred design, the distance d is less than the distance a. This permits the hinging action about the first hinges 22 and 36 to occur with less resistence against the portion of the front panel 14 against which the portions 58, 60 and 62 abut. It is also preferred to make the distance c larger than either distance a or d to resist contact between portions 58, 60 and 62 and the inner portion of front panel 14. The distance b should be selected to permit the freedom of motion from the angle $\theta$ to angle $\theta''$as illustrated in FIGS. 4*a* and 4*c*.

The report cover 10 also provides other significant advantages. Because the report 12 is only secured to the front panel 14 and rear panel 16 by staples, the report cover 10 can be readily disassembled and reassembled to insert or remove pages from the report 12. The typical paper report can be stapled along portion 58 numerous times before the report becomes worn or destroyed. The front panel 14 also acts to hide the staples 50 or other fastening structure which provides a more pleasing appearance to the report cover 10. The use of staples 50 to fasten the report 12 to the panels 14 and 16 also eliminates the need for costly devices to perform the rigidly accurate alignment of the report as needed in the prior art devices requiring a series of precisely aligned holes or slots for accepting pins or flexible rings as described previously. Portion 64 also acts as a convenient accent strip and can be embossed with any information desired.

In one report cover constructed in accordance with the teachings of the present invention, the distances employed are as follows: a=5/16 inch, b=$\frac{3}{8}$ inch, c=$\frac{1}{4}$ inch, d=5/16 inch, and e=5/16 inch. This report cover was used to hold a report printed on $8\frac{1}{2}$ inch by 11 inch paper.

The panel module 54 can be fastened to any edge of the report 12 desired. For example, it would be more advantageous to fasten tax reports along the top edge of the tax reports. The module 54 would then be fastened along the upper portion of the inner rear cover portion 44 of cover 18. The tax report pages could then be opened by flipping the pages upwardly.

Figure 5:
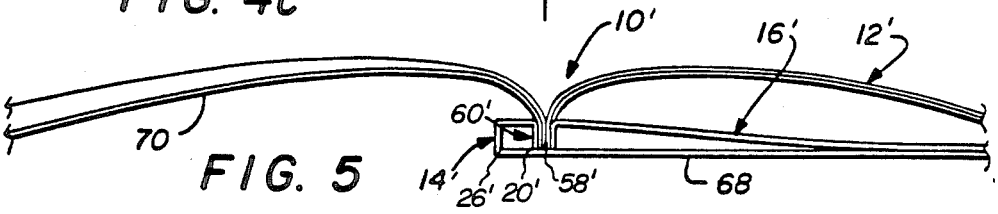
FIG. 5 illustrates a report cover forming a modification of the report cover illustrated in FIGS. 1–4.

A first modification of the report cover 10 is illustrated in FIG. 5. Many similar elements are used in the modification shown in FIG. 5. However, the modification illustrated in FIG. 5 does not require a cover 18 having front and rear cover portions 40 and 44 and an end portion 42 (FIGS. 1–4). The front panel 14' has an extended portion 68 on the side of the third hinge 26' opposite the first edge 20' which forms the rear cover of the report cover 10'. It is therefore unnecessary to provide the modification with adhesive strips 28 and 30. A single front cover 70 is used with the modification shown in FIG. 5 and is fastened between the portions 58' and 60' of the front panel 14' and report 12' as shown in FIG. 5.

Although only one embodiment of the present invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the scope and spirit of the invention.

I claim:

1. A report cover for holding a report, comprising:

a front panel having a first edge and at least three parallel hinges proximate the first edge;

a back panel;

the report being fastened to the front and back panels with first fastening means between the front and back panels along one edge of the report, the fastening of the front panel being between the first edge of the front panel and the closest hinge to said first edge; and the front panel being folded about said at least three parallel hinges to cover the edge of the report and hold the report and fastened to the back panel by second fastening means when the report is fastened between the front and back panels, the portion of the front panel between the first edge and first hinge thereof pivoting about the first hinge to remain parallel to the report where fastened thereto as the report is opened to resist forces acting to close the report.

2. The report cover of claim 1 further comprising:

a cover, the cover including a front cover portion, a rear cover portion and an end portion; and third fastening means for securing said front and back panels to the rear cover portion.

3. The report cover of claim 1, wherein said back panel has a first back panel edge and a first back panel hinge formed therein parallel said first back panel edge, said first fastening means fastening the back panel to the report between the first back panel edge and the first back panel hinge on said back panel, the portion of the back panel between said first back panel edge and said first back panel hinge and the portion of the front panel between said first edge and said closest hinge to said first edge pivoting about said first back panel hinge and said closed hinge to said first edge as the report is opened and closed to resist forces tending to close the report.

4. The report cover of claim 1 wherein a portion of the front panel extending from the hinge most distant from the first edge forms a back cover, said report cover further comprising a front cover, said first fastening means further fastening the front cover between the front panel and report.

5. A report cover for a report, said report cover comprising:

a front panel having a first edge and at least three parallel hinges proximate the first edge and extending generally parallel thereto;

a back panel having a first edge and at least one hinge proximate the first edge and extending generally parallel thereto;

the report being fastened to the front and rear panels with first fastening means between the front and back panels along one edge of the report proximate the first edges of the front and back panels between the first edges and the closest hinge to the first edge on each of said panels;

the front panel being folded at said at least three hinges to cover the edge of the report and to extend along the back panel on the side opposite the report when the report is fastened to the front and back panels; and the front panel being secured to the back panel by second fastening means when the report is fastened to the front and back panels at a predetermined distance from the hinge on said back panel, the hinges proximate the first edge on the front and back panels cooperating to permit the report to be opened to selected pages and remain opened in the absence of an external force when the front and back panels are fastened together, the portions of the front and back panels between the first edges and the proximate hinges remaining in planes parallel to the portion of the report to which they are fastened.

6. The report cover of claim 5 wherein said second fastening means comprises adhesives.

7. The report cover of claim 5 further comprising a cover having a front cover portion, a rear cover portion and interconnected by an end portion; and third fastening means for fastening said front and back panel to the rear cover portion of the cover.

8. The report cover of claim 5 further comprising a front cover, said first fastening means further fastening the front cover between the front panel and report, the front cover and front panel combining to form a cover.

9. A report cover for a report, said report cover comprising:

a front panel having a first edge, first, second and third parallel hinges spaced sequentially from the first edge and generally parallel thereto;

a back panel having a first edge and a first hinge formed generally parallel the first edge;

the report being fastened to the front and back panels with first fastening means between the front and back panels between the first edge and first hinge of each of said panels, the front panel being folded about the first, second and third hinges of said front panel when fastened to the report to cover the edge of the report and said first fastening means so that the portion of said front panel on the side of the third hinge opposite the first edge of the front panel is positioned in a plane generally parallel to and proximate the side of the back panel opposite the side facing the report; and a portion of the front panel on the side of the third hinge opposite the first edge of the front panel being fastened to the back panel along a line generally parallel the first hinge of the back cover panel and spaced a predetermined distance therebetween by second fastening means when the panels are fastened to the report, the portions of the front and back panels between the first edges and first hinges thereof and the edge of the report pivoting about the first hinges as the report is opened to resist forces acting to close the report, the portions of the front and back panels between the first edges and first hinges remaining in planes parallel to the portion of the report to which they are fastened, the predetermined distance between the fastening line and first hinge on the back panel permitting the front and back panels to separate proximate the first hinges to permit motion about the first hinges.

10. The report cover of claim 9 wherein said first fastening means comprises staples and said second fastening means comprises adhesives.

11. The report cover of claim 9 further comprising:

a cover having a front cover portion, end portion and rear cover portion; and third fastening means for fastening the portion of the front panel on the side of the third hinge opposite the first edge of the front panel to the rear cover portion of the cover.

12. The report cover of claim 11 wherein said third fastening means comprises adhesives.

13. The report cover of claim 9 further comprising a front cover fastened between the front panel and report by said first fastening means, the portion of said front panel on the side of the third hinge opposite the first edge forming a rear cover.

14. The report cover of claim 9 wherein the distance between the first edge and first hinge on the rear back panel is no greater than the distance between the first edge and first hinge on the front panel.

* * * * *